United States Patent [19]

Alston et al.

[11] Patent Number: 4,977,967

[45] Date of Patent: Dec. 18, 1990

[54] STEERING AND LUBRICATING APPARATUS FOR PORTABLE EARTH BORING MACHINE WITH STEERING HEAD

[75] Inventors: Howard W. Alston, Chagrin Falls; Ronald E. Peacock, West Salem; Douglas G. Schondell, Ashland, all of Ohio

[73] Assignee: Augers Unlimited, Inc., Ashland, Ohio

[21] Appl. No.: 411,564

[22] Filed: Sep. 22, 1989

[51] Int. Cl.[5] ..... E21C 1/10

[52] U.S. Cl. ..... 175/45; 175/73; 175/122; 173/154

[58] Field of Search ..... 175/45, 61, 62, 73, 175/74, 75, 76, 122, 171; 74/467; 173/154

[56] References Cited

U.S. PATENT DOCUMENTS

| | | | |
|---|---|---|---|
| 3,612,195 | 10/1971 | Richmond | 175/122 |
| 3,693,734 | 9/1972 | Richmond | 175/122 |
| 3,851,716 | 12/1974 | Barnes | 175/45 |
| 3,870,110 | 3/1975 | Richmond | 173/163 |
| 4,013,134 | 3/1977 | Richmond et al. | 175/73 |
| 4,329,887 | 5/1982 | Kawamoto | 74/467 |

*Primary Examiner*—William P. Neuder
*Attorney, Agent, or Firm*—Reese Taylor

[57] ABSTRACT

A combined steering and lubricating apparatus for use with earth boring apparatus includes a casing extension pivotally attached to one end of a casing section and controlled by an elongate tube which is movable along an axis parallel to the axis of the casing to pivot the casing extension. The invention includes a first connector for connecting one end of the tube to the casing extension and a second connector assembly connected to the other end of the tube for moving the tube and pivoting the casing extension and for providing lubricating fluid to the tube and first connector for deposit on the exterior of the casing.

14 Claims, 2 Drawing Sheets

STEERING AND LUBRICATING APPARATUS FOR PORTABLE EARTH BORING MACHINE WITH STEERING HEAD

BACKGROUND OF THE INVENTION

This invention relates in general to portable earth boring machines of the type adapted for the horizontal boring of shafts wherein horizontal holes are formed and sections of pipe casings are pushed into said holes and relates in particular to a combined steering and lubricating apparatus for use with such boring machines.

DESCRIPTION OF THE PRIOR ART

It is well-known that in certain instances it is undesirable to excavate trenches for the laying of pipes or pipelines which are used for various purposes such as sewers, utilities, etc. In those situations, the solution is to bore horizontal shafts beneath the surface of the earth. This generally consists of inserting an auger to which a boring head is attached through the interior of a section of pipe casing with the boring head projecting from the forward end of the casing. The boring head is then rotated to excavate the dirt, rock, etc., and bore the hole with the material being removed back through the pipe casing and with the auger serving as a conveyor for the material removed from the bore. Simultaneously with the boring operation, the casing is advanced into the bore by a pusher.

The pusher generally includes spaced track members which are disposed in a trench adjacent to the starting point of the bore and in axial alignment with the bore. A power train for rotating the auger and boring head is supported on a carriage which is mounted on the rails for movement therealong, and a pusher ring for driving sections of the casings into the bored holes is also provided on the carriage.

It has been found that some difficulties can be encountered in this type of boring where, for one reason or another, the actual boring line deviates from the desired pipeline path. This is particularly significant in drains or sewers where, of course, it is desirable to have the resulting pipeline disposed in the proper orientation.

Richmond U.S. Pat. No. 4,013,134 discloses an improvement to boring machines of this general type wherein an adjustable steering head is provided and attached to the end of the casing which is inserted into the bore. That patent discloses a casing extension or second casing member which is pivotally mounted to the distal end of the main casing section and which can be controlled from the proximal end of the casing section so as to tilt, effectively, the casing extension above or below the centerline and cause the bore hole to be inclined upwardly or downwardly as the case may be to conform the bore to the desired grade.

The invention just referred to is believed to be desirable and operable for the purposes for which it is designed. It has, however, been found that in many instances it is also desirable to be able to lubricate the outer periphery of the casing section as the boring and casing insertin proceeds. This has the obvious advantage of facilitating insertion of the casing into the bore.

This problem has been confronted in some instances by mounting a line or tube on the outside of the casing and attaching the proximal end to a source of lubricant such as bentonite or water. While this approach has some efficacy, it is not totally satisfactory since it involves an extra assembly operation at the work site.

Also, in many instances, operators prefer to drill without the added expense and trouble of using a lubricant. Thus, often, no provision is made for lubrication prior to beginning the drilling operation. Unfortunately, it often happens that part way through the drilling operation, with one or more casings inserted into the bore, difficulties are encountered which then require lubrication and no means for providing it are readily available.

Therefore, it is desirable to provide a means for lubrication which is readily available for use as desired and which requires no additional fabrication.

SUMMARY OF THE INVENTION

It accordingly becomes the principal object of this invention to provide a combined steering and lubricating apparatus for use with earth boring apparatus of the type just described and including the steering function of Richmond U.S. Pat. No. 4,013,134 wherein the exterior surface of the casing can be lubricated by apparatus incorporated with the steering linkage.

It has been found that by providing a steering apparatus, which comprises an elongate hollow tube connected at one end to the casing extension for steering purposes and at the other end to both adjustment means for steering purposes and a source of fluid supply for lubricating purposes, this object can be achieved.

It has been further found that the achievement of the principal object of the invention can be facilitated by providing a first connector for releasable pivotal attachment of the hollow tube to the casing extension for steering purposes and with said connector being hollow and having radially directed apertures provided therein for directing the lubricating fluid onto the surface of the casing.

It has further been found that achievement of the principal object of the invention can be facilitated by providing improved adjustment means in the form of a second connector mounted at the remote end of the hollow tube, which connector can precisely and mechanically adjust the angle of the casing extension by pushing or pulling the tube for steering purposes and which second adapter can also be provided with a hollow body which can be fluidly connected to a source of fluid supply for supplying the lubricating fluid.

It has further been found that achievement of the principal object of the invention can be facilitated by providing for releasable attachment of the second connector to the hollow tube and to the casing so that it can readily be removed and attached to the next succeeding casing section.

It has further been found that the lubricating function can be still further improved by providing one or more apertures in the hollow tube itself adjacent its distal end to provide even more lubricant to the casing.

Accordingly, production of an improved steering and lubricating apparatus for use with a portable earth boring machine with a steering head of the character above described becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
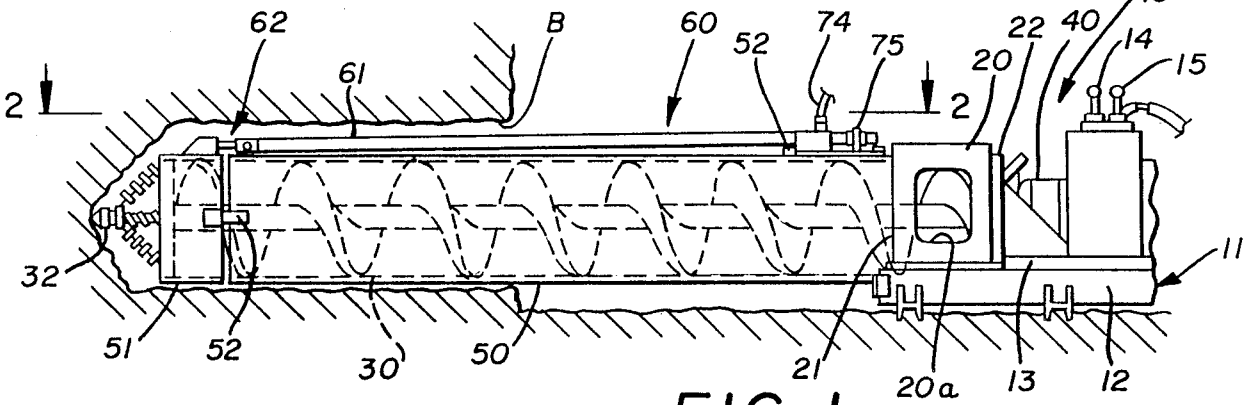
FIG. 1 is a side elevational view of the boring machine of the present invention, illustrating both the improved steering and lubricating apparatus and the driving apparatus.
Figure 2:
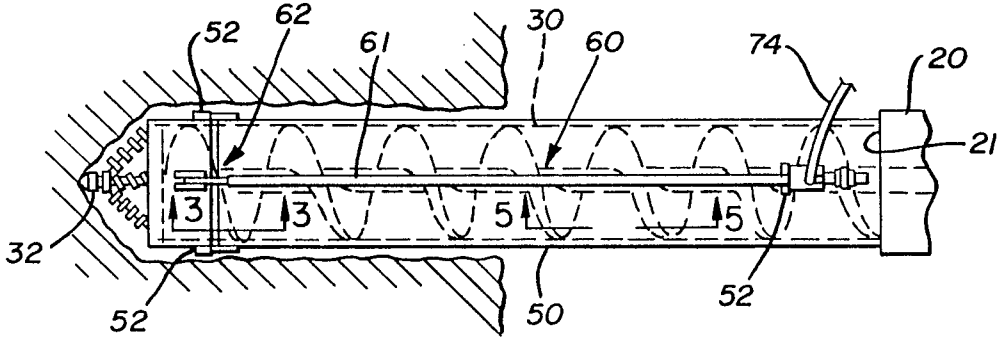
FIG. 2 is a partial top elevational view of the apparatus taken along the line 2—2 of FIG. 1.

Referring first to FIGS. 1 and 2 of the drawings for an overall consideration of the improved apparatus, it will be noted that the horizontal boring machine 10 is substantially illustrated therein and includes a base 11 which itself includes parallel tracks 12, only one of which is visible in FIG 1, and a carriage 13 which rides thereon so that the machine can be moved toward or away from the bore B as desired.

A pusher ring 20 is carried by carriage 13 and is provided with a thrust plate 22 having a front annular surface 21 which is intended to receive the proximal end of the casing 50 which seats therein so that it can be driven into the bore thereby. Also illustrated in FIG. 1 of the drawings are control valves 14 and 15 which control the power cylinders which move the carriage 13 along the tracks 12. Also illustrated in FIG. 1 is a drive assembly 40 for driving the auger 30.

Richmond U.S. Pat. No. 3,612,195 can be referred to for a typical illustration and description of power pushing cylinders, and Richmond U.S. Pat. No. 3,693,734 may be referred to for typical auger assemblies. The drive assembly can also be seen from the illustrations and descriptions in Richmond U.S. Pat. No. 3,870,110. None of this apparatus is illustrated or described in great detail herein, since it is well illustrated in the patents just referred to and in many respects is well-known in the art. Also, the precise apparatus for actuating the augar or for driving the casing into the bore are relatively unimportant to the present invention which essentially deals with the improved steering and lubricating apparatus.

To that end, and still referring to FIGS. 1 and 2 of the drawings, it will be noted that, as just discussed, the casing 50 is an elongate hollow pipe casing of conventional type and of any desired length, one end of which projects into the bore and will be referred to herein as the distal end, and the other end, which will be referred to herein as the proximal end, is engaged by the front annular surface 21 of the pusher ring 20, as just mentioned. The auger is also of relatively conventional structure and is generally indicated by the numeral 30 of the drawings. It will be understood that the invention will primarily be described in connection with one casing section 50 of a fixed length and one or more auger sections 30 of a total length compatible with the casing length. It will be understood, however, that after the first casing section 50 is inserted into the bore, a second casing section will be welded thereto and additional auger sections will be attached to the original section or sections and the operation will proceed and continue until a bore of sufficient length has been achieved to accomplish the object of the operation.

Still referring then to FIGS. 1 and 2 of the drawings, it wil be noted that, in addition to the casing 50, a casing extension or second short casing piece 51 is hingedly attached as at 52 to the distal end of the casing 50 or, in other words, the end which is inserted into the bore B. Likewise, a boring head 32 is secured to the front end of the auger and projects from the casing extension 51.

As is well-known in this art, as the auger 30 is rotated, the boring head 32 will bore through the material such as dirt, rock, etc., and the material will be passed back through the casing 50 and out of opening 20*a* in pusher ring 20 with the auger serving as a conveyor therefore. Simultaneously, the casing will be shoved into the hole or bore B thus created by the head 32 by the pusher ring 20.

Figure 3:
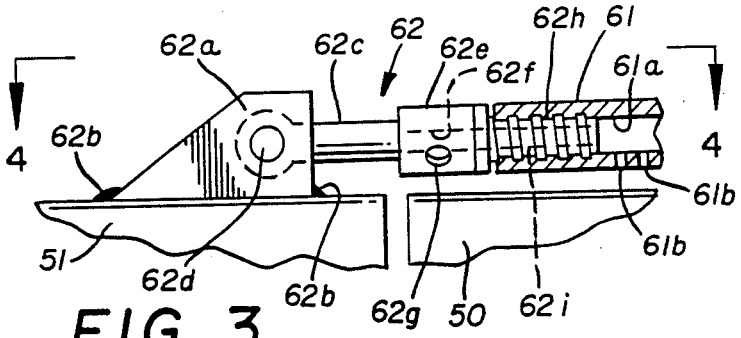
FIG. 3 is a sectional view taken along the line 3—3 of FIG. 2.
Figure 4:
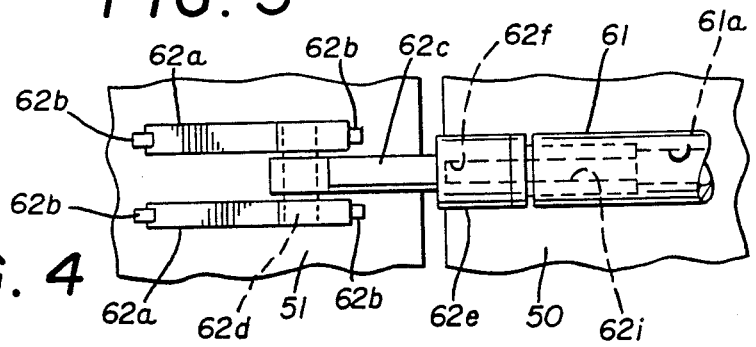
FIG. 4 is a top plan view of the apparatus of FIG. 3 taken along the line 4—4.

Turning then to FIGS. 1, 3 and 4 for a description of the steering and lubricating apparatus, that apparatus is generally indicated by the numeral 60 and includes, as an essential component, an elongate hollow tube 61 which is movable linearly along its longitudinal axis.

Referring specifically to FIGS. 3 and 4 of the drawings, it will be noted that the tube 61 is attached to the casing extension 51 by a pivot block assembly 62.

The casing extension 51 has pivot brackets 62*a*,62*a* attached thereto as by welding, as indicated at 62*b*,62*b*. A first connector assembly connects these brackets 62*a*,62*a* to the distal end of tube 61. The first connector assembly includes a pivot shaft 62*c* which has one end bored for receipt of a pivot pin 62*d*, as can clearly be seen in FIG. 4 of the drawings. The other end of the pivot shaft 62*c* is secured to a housing 62*e*. That housing 62*e* is enlarged and has an axial counter bore 62*f*. That counter bore 62*f* is in fluid communication with the exterior of the housing by one or more radially directed apertures 62*g* for purposes of dispersing the lubricating fluid onto the exterior surface of the casing 50. In that regard, the apertures 62*g* may be located as desired with respct to the distal end of casing 50, but preferably a sufficient distance inboard of the end to insure that the lubricant flows about the exterior of the casing and not into the interior thereof.

The housing 62*e* terminates in a threaded extension 62*h* which is received within the elongate tube 61 and releasably secured thereto by engagement with complemental interior threads on the tube 61. The extension 62*h* also has an axial bore 62*i* which communicates with counter bore 62*f* in housing 62*e* and the interior 61*a* of tube 61. In this fashion, if the tube 61 is moved either to the right or the left of FIG. 3 of the drawings, the casing extension 51 will be tilted either upwardly or downwardly and the direction of the hole being bored will be controlled. That basic movement and control is fully described in Richmond U.S. Pat. No. 4,013,134. Also by this arrangement, fluid forced through tube 61 will be forecd out onto casing 50 through apertures 62*g*.

Figure 5:
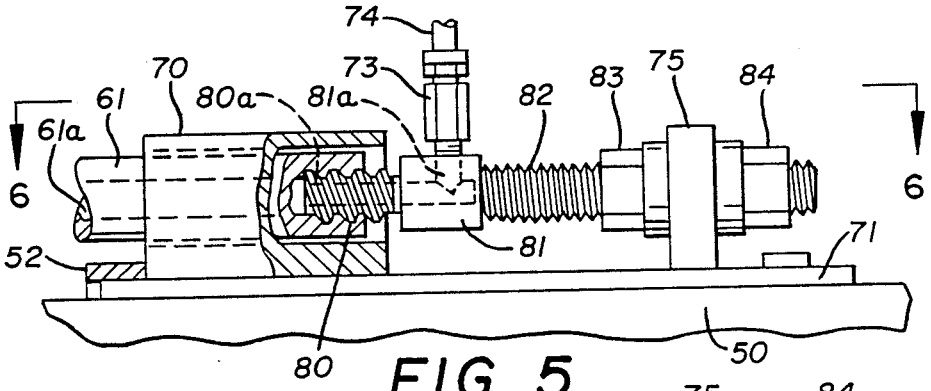
FIG. 5 is a sectional view taken along the line 5—5 of FIG. 4.
Figure 6:
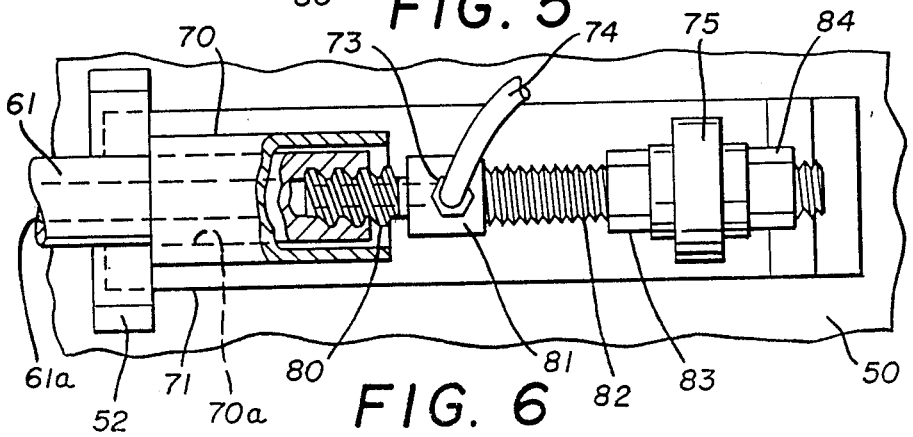
FIG. 6 is a top plan view taken along the line 6—6 of FIG. 5.

Turning then to FIGS. 5 and 6 of the drawings, it will be noted that the tube 61 is connected at its opposed or proximal end to an adjusting block assembly. This adjusting block assembly includes a housing 70 which is mounted on a base plate 71. It will also be noted that bracket 52 is mounted on the periphery of the casing 50 adjacent its proximal end. This is simply a U-shaped bracket and is dimensioned so that its base is spaced above the casing surface sufficiently so that the end of base plate 71 can slip into and out of that bracket in order that the adjustment and control apparatus can be removed, as will be described.

Still referring to FIGS. 5 and 6 of the drawings, it will be noted that the housing 70, which is mounted on the base plate 71, includes a through bore 70*a*. This bore receives the proximal end of the tube 61 which is interiorly threaded at that end for receipt of a second connector member, which will be described below.

Still referring to FIGS. 5 and 6 of the drawings, it will be noted that the secnd connector which is provided includes an elongate threaded shaft 80, one end of which is adapted to be threadingly engaged with the end of the tube 61. It will also be noted that shaft 80 has a through axial bore 80*a* which is in fluid communication with bore 61*a* of tube 61 when the shaft is connected thereto. The other end of shaft 80 joins housing 81. That housing has a right angle bore in it, as indicated at 81*a*, which is threaded for receipt of the fluid fitting 73 and for communication with bore 80*a*. Thus, fluid interjected from tubing 74, which is connected to a suitable source of fluid supply (not shown), through the fitting 73 will pass through the elongate threaded shaft 80 and on into the tube 61 and ultimately out the hole or holes 62*g* at the opposite end.

Further outboard of the housing 81 is a second threaded shaft 82 and this threaded member extends to the rear of the second connector.

It will be noted that mounted on the base plate 71 is a threaded bracket 75 for receipt of the second threaded shaft 82 of the connector. This shaft 82 also receives hex adjustment nuts 83,84. It will be apparent that upon rotation of nuts 83,84, the second connector, and thus the tube 61, can be advanced or withdrawn with respect to the distal end of casing 50 and the result will be to pivot the casing extension upwardly or downwardly. The adjustment nuts are mounted on opposed sides of the bracket 75 and, by proper prior calculations, it can be ascertained that depending upon the degree of extension or number of threads on either side of the bracket 75, the angle of inclination of the casing extension 51 can be precisely determined. Also, by tightening the nuts against bracket 75, the angle of inclination can be locked in place.

It has been ascertained that, for example, if an equal number of threads project on either side of the bracket 75, the casing extension 51 should be coaxial with the casing 50 or, in other words, straight. Then, by adjusting the hex nuts 83,84 so as to move the shaft 82 either to the right or the left of FIG. 5, which will move tube 61 in the appropriate direction, this will indicate whether the casing extension 51 is inclined up or down from the horizontal. Also, by counting the number of exposed threads, it is possible to precisely ascertain the angle of inclination of the casing extension 51 by prior calculation of the movement of the casing extension 51 per revolution of the nuts. This will vary the casing diameter and location of the pivot point but, once ascertained, will permit precise adjustment.

As also noted in Richmond U.S. Pat. No. 4,013,134, sensing means can be attached to the casing to ascertain whether adjustment is required and that sensing means has not been illustrated herein.

In addition to facilitating steering, it will be seen that lubricant can be transmitted from the fluid source through hose 74 through bores 81*a*, 80*a*, 61*a*, 62*i*, 62*f* and 62*g* to the casing exterior by utilization of the unique connectors.

As previously noted, once the first casing section 51 has been inserted into the bore B for most of its length, it is necessary to attach to a second casing section and additional auger sections. This is accomplished by disconnecting the end of the auger shaft and backing off the pusher assembly and the auger driving means. A second casing section is then butted up against the first casing section and welded thereto. A second auger section or sections is also attached to the first auger section and again attached to the activating means.

Obviously, in this instance, it is then necessary to provide for maintaining the steering and lubricating capabilities. That is simply accomplished with the present invention by disconnecting the connector shaft 80 from the end of the hollow tube 61 and removing the entire housing assembly 70, including the base plate 71. This is simply accomplished by slipping the end of base plate 71 out from under the bracket 53. At that point, a second hollow tube assembly 61 can be connected and welded to the first, and the housing assembly can be snapped into another bracket 53 on the next succeeding casing section. The connector shaft 80 is then threaded into the end of the tube 61, and the apparatus is ready for further operations.

Of course, it will be readily apparent that by injecting lubricating fluid, either water or some other specific type of lubricating fluid such as bentonite or driller's mud, through the hose 74 in the fitting 73, it wll be injected into the interior of the hollow tube 61 and ultimately out through the aperture 62*b* in the housing at the distal end. In this way, the lubricating fluid will be directed down onto the outer surface of the casing and will continue to facilitate the boring operation.

In some instances where an increased amount of lubrication is believed desirable, it is possible to provide additional bores in the tube 61 itself. As illustrated at 61*b*,61*b*, these generally would be provided adjacent the projecting or distal end of the tube 61 or, in other words, adjacent the pivot block area and would most likely be provided in the lower half of the tube so as to insure that the lubricating fluid is directed onto the surface of the casing.

It will thus be seen that the steering advantage of the prior art can easily be coupled with a lubricating advantage by utilization of the apparatus of the present invention with little or no extra on site fabrication. Furthermore, with Applicants' invention, the lubricating capability is present for use at all times in that one may bore for a period without lubrication if desired and then begin lubrication when required.

Additionally, it will be noted that the connectors are readily reusable since they can easily be removed from the distal and proximal ends to the casings when the job is completed.

While a full and complete description of the invention has been set forth in accordance with the dictates of the Patent Statutes, it should be understood that modifications can be resorted to without departing from the spirit hereto or the scope of the appended claims.

What is claimed is:

1. Combined steering and lubricating apparatus for use with an earth boring apparatus of the type that forms horizontal holes and pushes sections of casings into said holes, comprising:

(a) a casing section;

(b) a casing extension pivotally attached to one end of said casing;

(c) pivot means connecting said casing to said casing extension for pivoting said casing extension relatively of said casing;

(d) control means mounted on the exterior of said casing adjacent the opposed end thereof and connected to said pivot means;

(e) said control means being adapted for releasable connection with a source of fluid;

(f) said pivot means being in fluid communication with said control means and the exterior of said casing whereby fluid may be deposited on the exterior of said casing adjacent its point of attachment to said casing extension; and (g) said pivot means and said control means being interconnected by an elongate hollow tube and releasably connected to opposed ends thereof by hollow first and second connectors in fluid communication with the interior of said tube.

2. The apparatus of claim 1 wherein said pivot means includes a pivot bracket mounted on said casing extension and an elongate said first connector having one end pivotally attached to said bracket and its opposed end releasably attached to one end of said elongate hollow tube.

3. The apparatus of claim 2 wherein said first connector includes a pivot arm, one end of which is apertured for receipt of a pivot pin and for attachment to said bracket; a hollow body portion secured to the opposed end of said pivot arm and a hollow threaded extension secured to said body for releasable attachment to said one end of said tube; said body having at least one radial bore therein.

4. The apparatus of claim 1 wherein said control means include a housing releasably mounted on said casing.

5. The apparatus of claim 4 wherein said second connector is releasably and adjustably attached to the opposed end of said elongate hollow tube.

6. The apparatus of claim 5 wherein said second connector includes a first hollow, threaded end for engagement with said tube, an enlarged hollow body attached to said first end; and a second threaded end projecting from said body.

7. The apparatus of claim 6 wherein said housing includes a threaded bracket for receipt of said second threaded end of said second connector.

8. The apparatus of claim 4 wherein a mounting bracket is attached to said casing; and said housing includes a base plate for releasable engagement with said bracket.

9. The apparatus of claim 7 wherein adjustment means are threadingly received on said second threaded end of said second connector and disposed on opposed sides of said threaded bracket.

10. The apparatus of claim 1 wherein said elongate hollow tube has at least one through radially directed aperture in proximity with the end thereof adjacent said casing extension.

11. Steering apparatus for attachment to a pipe casing, comprising:

(a) a casing extension pivotally attached to one end of the casing;

(b) steering means disposed on the exterior surface of the casing and including (1) a first connector releasably attached to said casing extension, (2) an elongate hollow tube, one end of which is releasably attached to said first connector, (3) a second connector assembly releasably attached to the opposed end of said tube;

(c) said first connector being in fluid communication with the interior of said hollow tube;

(d) said second connector assembly being in fluid communication with an external source of fluid supply and with the interior of said hollow tube; and (e) means for advancing and retracting said steering means along an axis parallel to the axis of the casing.

12. The apparatus of claim 11 wherein said first connector is in fluid communication with its own exterior surface.

13. The apparatus of claim 11 wherein said hollow tube has at least one through radial aperture therein; and said second connector assembly is in communication with a source of fluid supply.

14. The apparatus of claim 11 wherein said second connector assembly includes a threaded shaft extending parallel to the axis of said casing; a threaded backet projecting radially with respect to said casing; and adjustment means disposed on said threaded shaft and on opposed sides of said bracket.

* * * * *

UNITED STATES PATENT AND TRADEMARK OFFICE

CERTIFICATE OF CORRECTION

PATENT NO. : 4,977,967

DATED : December 18, 1990

INVENTOR(S) : Howard W. Alston et al.

It is certified that error appears in the above-identified patent and that said Letters Patent is hereby corrected as shown below:

In Column 1, line 63, delete "insertin" and substitute therefor --insertion--.

In Column 3, line 44, delete "augar" and substitute therefor --auger--.

In Column 4, line 12, delete "therefore" and substitute therefor --therefor--.

In Column 4, line 55, delete "forecd" and substitute therefor --forced--.

In Column 5, line 8, delete "secnd" and substitute therefor --second--.

In Column 5, line 54, between the words "vary" and "the", insert --with--.

In Column 6, line 25, delete "wll" and substitute therefor --will--.

In Column 6, line 56, delete "hereto" and substitute therefor --hereof--.

In Column 8, line 41, delete "backet" and substitute therefor --bracket--.

Signed and Sealed this

Fourth Day of August, 1992

*Attest:*

DOUGLAS B. COMER

*Attesting Officer*

*Acting Commissioner of Patents and Trademarks*